US009291969B2

(12) United States Patent
Endo et al.

(10) Patent No.: US 9,291,969 B2
(45) Date of Patent: Mar. 22, 2016

(54) BASE FOR FIXING BELT, FIXING BELT, FIXING DEVICE, AND IMAGE FORMING APPARATUS

(71) Applicants: Hiroyuki Endo, Kanagawa (JP); Shigeru Fujita, Kanagawa (JP); Yuzuru Kudoh, Kanagawa (JP); Yasuhide Fujiwara, Kanagawa (JP)

(72) Inventors: Hiroyuki Endo, Kanagawa (JP); Shigeru Fujita, Kanagawa (JP); Yuzuru Kudoh, Kanagawa (JP); Yasuhide Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/185,120

(22) Filed: Feb. 20, 2014

(65) Prior Publication Data

US 2014/0241771 A1 Aug. 28, 2014

(30) Foreign Application Priority Data

Feb. 26, 2013 (JP) ..... 2013-035684
Dec. 20, 2013 (JP) ..... 2013-263678

(51) Int. Cl.
*G03G 15/20* (2006.01)

(52) U.S. Cl.
CPC ..... *G03G 15/2057* (2013.01)

(58) Field of Classification Search
USPC ..... 399/122, 320, 328–333; 428/323, 411.1
See application file for complete search history.

(56) References Cited

U.S. PATENT DOCUMENTS

| | | | | |
|---|---|---|---|---|
| 6,782,230 | B2 * | 8/2004 | Yaomin et al. | 399/326 |
| 7,457,577 | B2 * | 11/2008 | Matsunaka | G03G 15/2053 399/333 |
| 2002/0146259 | A1 * | 10/2002 | Zhou et al. | 399/329 |
| 2005/0142351 | A1 * | 6/2005 | Takagi et al. | 428/323 |

FOREIGN PATENT DOCUMENTS

| | | |
|---|---|---|
| JP | 2000-026990 | 1/2000 |
| JP | 2004-183034 | 7/2004 |
| JP | 2005-089790 | 4/2005 |
| JP | 2005-165291 | 6/2005 |
| JP | 2006-084718 | 3/2006 |
| JP | 2007-286616 | 11/2007 |
| JP | 2009-004370 | 1/2009 |
| JP | 2010-217347 | 9/2010 |
| JP | 2012-168218 | 9/2012 |

* cited by examiner

*Primary Examiner* — Hoan Tran
(74) *Attorney, Agent, or Firm* — Oblon, McClelland, Maier & Neustadt, L.L.P.

(57) ABSTRACT

A base for a fixing belt includes a nickel layer; and a copper layer, both laminated each other, wherein an orientation ratio calculated based on a ratio between a peak strength of crystal face and a peak strength of crystal face by X-ray diffraction analysis of the copper layer is 0.1 or less. The base for the fixing belt further includes a protective layer, disposed on a surface of the copper layer opposite a surface on which the nickel layer is laminated, and the protective layer is formed of nickel.

16 Claims, 2 Drawing Sheets

BASE FOR FIXING BELT, FIXING BELT, FIXING DEVICE, AND IMAGE FORMING APPARATUS

CROSS-REFERENCE TO RELATED APPLICATIONS

The present application claims priority pursuant to 35 U.S.C. §119 from Japanese patent application numbers 2013-035684 and 2013-263678, filed on Feb. 26, 2013 and Dec. 20, 2013, respectively, the entire disclosures of which are incorporated by reference herein.

BACKGROUND

1. Technical Field

The present invention relates to a base for a fixing belt employed in a copier, a printer, or a facsimile machine employing electrophotography, and further to a fixing belt, a fixing device, and an image forming apparatus incorporating such a base for the fixing belt.

2. Related Art

In an image forming apparatus employing electrophotography, such as a copier, a printer, and a facsimile machine, a roller or a belt having a base layer of seamless, nickel-electroformed film is widely used as a heating and fixing member for fixing toner.

Herein, an example of a conventional toner fixing method will be described.

FIG. 1 illustrates an image forming apparatus; FIG. 2 illustrates a fixing device used in the image forming apparatus of FIG. 1; and FIG. 3 illustrates a cross-sectional view of a fixing belt used in the fixing device of FIG. 2, each of which is represented as a typical model.

As illustrated in FIG. 1, laser beams 13 are used to expose a photosensitive layer (which is previously charged by a charger) of a drum-shaped image carrier or a photoreceptor 11, based on image data, so that an electrostatic latent image is formed on the photoreceptor 11. In this case, the laser beams 13 are polarized periodically using a polygonal mirror which rotates at a predetermined speed so that the photosensitive layer of the image carrier 11 is scanned and exposed repeatedly in a main scanning direction perpendicular to a sub-scanning direction. In the present example, a roller-shaped image carrier is used; however, alternatively, a belt-shaped image carrier stretched around rollers may also be used. In this case, a transfer nip is formed between the belt-shaped image carrier and a transfer roller 15 at a portion where the belt-shaped image carrier is stretched around the roller-shaped rotary member.

Next, the electrostatic latent image thus formed on the photosensitive layer of the image carrier 11 is rendered visible by particulate toner supplied from the developing device 14 via a developing roller 14*a*, and thus, the toner image is formed. Thereafter, a transfer bias voltage having a polarity opposite that of the toner is applied to the transfer roller 15 from a transfer bias power supply 30. With this transfer bias voltage, the toner image is transferred to a transfer medium P that is conveyed from a sheet feeder via a conveyance roller pair 20, 21 to the transfer nip formed between the transfer roller 15 of the transfer device and the image carrier 11. Then, the toner image on the transfer medium P is pressed and fixed with a previously adjusted temperature by a fixing device 24, and the transfer medium P having the fixed image thereon is discharged to a paper discharge tray, not shown.

As illustrated in FIG. 2, the fixing device 24 includes a cylindrical or substantially cylindrical heat pipe 2 formed of thin aluminum. The heat pipe 2 includes a built-in heat generation member 1 such as a halogen heater in its center thereof. A pressure pad 4 is disposed inside the heat pipe 2. The pressure pad 4 is fixed on a stay 3 disposed inside the heat pipe 2. A seamless, electroformed nickel fixing belt 5 is mounted on a circumferential surface of the heat pipe 2. The fixing belt 5 is formed of a slidable layer, an elastic layer, and a release layer in that order from an inner side to an outer side. The heat pipe 2 is disposed opposite a pressure roller 6 via the fixing belt 5 in between, with the pressure pad 4 pressing against the fixing belt 5 from an interior side of the belt 5 to thus contact the fixing belt 5 against the pressure roller 6. The pressure pad 4 may be configured to be biased by a biasing device, not shown, toward the pressure roller 6. Alternatively, the pressure roller 6 may be biased by the biasing device, not shown, toward the pressure pad 4. Thus, a nip portion is formed between the fixing belt 5 and the pressure roller 6. In the fixing device 24, the fixing belt 5 is driven to rotate by the rotation of the pressure roller 6. When a transfer medium 7 on which a toner image is formed is supplied to the nip portion, the transfer medium 7 passes through the nip portion while being pressed and heated, and thus, the toner image is fixed thereon.

FIG. 3 illustrates an exemplary model of the fixing belt 5. A base of the fixing belt is formed of an electroformed nickel layer 51. A copper layer is laminated on the nickel layer 51, thereby improving heat conductivity.

A slidable layer 54 is laminated on an inner circumferential side of the endless belt-shaped base 51. The slidable layer 54 is formed of heat-resistant resins, such as polyimide (PI), and a copolymer of tetrafluoroethylene-perfluoroalkyl vinylether (PFA). Further, on an outer surface of the base 51, an elastic layer 52 formed of silicon rubber, and a release layer 53 formed of fluorine resins such as a copolymer of tetrafluoroethylene-perfluoroalkyl vinylether (PFA) are laminated onto the base 51, in that order.

The base for the fixing belt is formed by nickel electroforming as follows. First, a stainless, cylindrical master block the surface of which is polished and cleaned is soaked in a nickel electroforming bath and an electric current is applied to the bath so that nickel is precipitated on the surface of the master block. The cylindrical master block is taken out of the bath and the precipitated nickel electroformed film is demolded from the master block. Upper and lower ends are cut to obtain a proper length.

The fixing belt including a metal base layer is employed for the fixing device, an image forming apparatus employs such a fixing device, and a high speed print capability is at all times required for the image forming apparatus.

However, a base for the fixing belt is not always suitable for high speed printing due to a lack of durability. Specifically, due to perpetual demand for ever-higher speed, the fixing belt is driven at a higher speed than in the conventional art, is subjected to higher pressure at a nip, and is repeatedly deformed in a shorter time period, causing cracks due to metal fatigue.

In response to the demand for higher speed, JP-2010-217347-A proposes a fixing belt formed of a base from an inner side including stainless steel, copper, and stainless steel laminated in that order. The belt formed of laminated stainless steel and copper is manufactured by a plastic molding process such as metallic rolling. Compared to electroformation, the plastic molding is inferior in terms of evenness of the thickness and moreover warps due to uneven processing remain, so that the durability is poor.

JP-2004-183034-A discloses use of electroformed nickel film as the base for the fixing belt with its crystal orientations, of which the crystal orientation ratio I(200)/I(111) is 80 or higher but 250 or lower and contains 0.03 to 0.10 mass % carbon. The same discloses that such nickel crystal orientation ratio contributes to durability. However, because nickel has a low heat conductivity, if nickel alone is used for the fixing belt, uneven heat conductivity is generated in the axial direction, which may cause a problem of defective image formation in high speed printing.

JP-2006-84718-A discloses a technique in which a cylindrical seamless nickel belt is manufactured by electroforming process by immersing a cylindrical metal master in an electrolytic solution containing not only nickel but also 10-10,000 ppm by volume fraction of at least one metal element selected from groups I, VI, VII and VIII of the Periodic Table. Nickel crystal orientation ratio I(200)/I(111) is set to ≥5.0. The same relates to an organic photoreceptor and does not consider heat conductivity. However, if such a material is used for the base of the fixing belt, unevenness of the heat in the axial direction will be caused.

SUMMARY

The present invention provides a base for a fixing belt having excellent durability and capable of handling high-speed printing, including at least a nickel layer and a copper layer laminated onto the nickel layer, in which an orientation ratio I(200)/I(111) calculated based on a ratio between a peak strength of (200) crystal face and a peak strength of (111) crystal face by X-ray diffraction analysis of the copper layer is 0.1 or less.

The present disclosure further provides an endless fixing belt having the base described above, a fixing device incorporating the fixing belt, and an image forming apparatus incorporating the fixing device.

These and other objects, features, and advantages of the present invention will become apparent upon consideration of the following description of the preferred embodiments of the present invention when taken in conjunction with the accompanying drawings.

DETAILED DESCRIPTION

Figure 1:
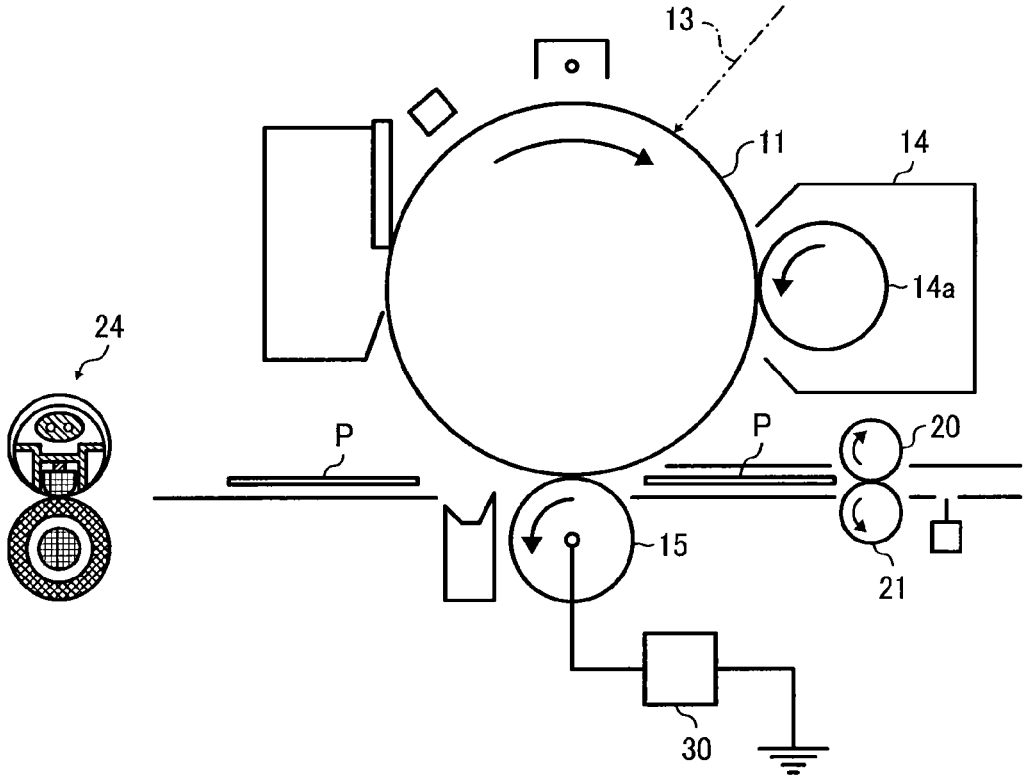
FIG. 1 BACKGROUND ART
FIG. 1 is an exemplary model of an image forming apparatus for use in an embodiment of the present invention.

A base for a fixing belt used in an image forming apparatus will be described. The base for the fixing belt according to the present invention includes a nickel layer and a copper layer laminated one after another.

A preferred thickness of the base for the fixing belt is from 10 μm to 60 μm. A more preferred range is from 20 μm to 50 μm. If the thickness of the base for the fixing belt is less than 10 μm, stiffness as the base for the fixing belt is not satisfactory. By contrast, if the thickness is more than 60 μm, flexibility of the belt declines.

The base for the fixing belt is formed as follows. First, using an electroforming master block formed of stainless steel and a nickel electroforming method, a nickel layer is formed.

The nickel layer mainly applies stiffness to the base of the fixing belt, so that the thickness thereof is preferably greater than that of a copper layer, which will be described later. If the nickel layer is not thick enough, sufficient durability for the fixing belt may not be obtained.

The electroformed nickel layer is demolded from the master block, and is washed if necessary. Next, copper electroforming is performed.

The copper layer mainly supplies heat conductivity to the base of the fixing belt, so that the thickness thereof is preferably greater than 1 μm. A more preferred range is 5 μm or more. If the copper layer is not thick enough, sufficient heat conductivity may not be obtained for the fixing belt.

In the present invention, crystal orientation ratio I(200)/I(111) calculated from the ratio between a peak strength of (200) crystal face and a peak strength of (111) crystal face measured by X-ray diffraction of the copper layer should be 0.1 or less. If the ratio is greater than 0.1, a fixing belt having sufficient durability cannot be obtained.

Specifically, if the fixing belt employs a base including the copper layer and the nickel layer laminated each other, the copper layer begins to crack and induces a subsidiary fracture. By making the orientation ratio at the prescribed range, durability of the copper layer may be improved drastically. As a result, a fixing belt with higher durability can be obtained.

Such a copper layer can be obtained by the electroforming method as follows.

The copper electroforming bath for use includes copper sulfate and sulfate alone. Specifically, solutions of 60 to 100 grams/L of copper sulfate (II) pentahydrate $CuSO_4.5H_2O$ and 180 to 220 grams/L of sulfate $H_2SO_4$ are used. Temperature of the electroforming bath is adjusted to 55±3 degrees C., and an electric current of 1 to 5 A/dm$^2$ is passed through the bath while rotating the master block, thereby obtaining a copper layer with an orientation ratio I(200)/I(111) of 0.1 or less.

Herein, it is noted that if additives such as gelatin (gloss adjuster) or hydrochloric acid are added to the copper coating bath, although commonly included therein, effects of the present invention may not be obtained.

The thus-electroformed product including a nickel layer and a copper layer, with the copper laminated onto the nickel, can be used as a base. However, when stored as is, the exposed surface of the copper layer is oxidized and adhesiveness of the obtained product at a time of manufacturing the fixing belt will be degraded, so that sufficient durability cannot be obtained.

The above problem can be solved by disposing a protective layer on the exposed surface of the copper layer.

As a protective layer, a peelable resin film may be attached for preventing oxidization, so that the film may be easily demolded when manufacturing the fixing belt. The protective layer may be formed alternatively of a heat-resistant resin layer such as polyimide or polyamide-imide, and is processed into the fixing belt with the heat-resistant resin layer laminated as is.

Further, the protective layer may be formed of nickel. In this case, because the nickel layer is rarely oxidized, the copper layer protected by the nickel layer as the protective layer can be protected from oxidation. As a result, because cracking in the copper layer when used as the fixing belt is minimized, a highly durable fixing belt can be obtained. The nickel layer can be formed by the electroforming method using the above-described equipment and electroforming bath. When the nickel layer is disposed as a protective layer, the thickness thereof is in a range so as not to degrade flexibility of the base for the fixing belt while at the same time preventing air from contacting the copper layer, and therefore, the preferred range is from 0.5 μm to 5 μm or less.

On the outer circumference of the base for the fixing belt formed in the endless belt shape with a protective layer) disposed on the outer circumference of the endless belt, an elastic layer and a release layer are laminated in that order.

Figure 4:
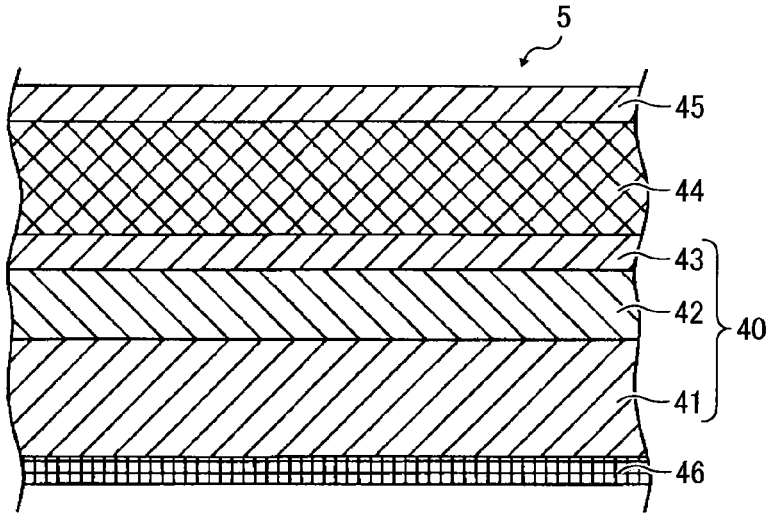
FIG. 4 is a cross-sectional view illustrating a structure of a fixing belt according to an embodiment of the present invention.

FIG. 4 is a cross-sectional view illustrating a structure of a fixing belt 5 according to an embodiment of the present invention. The base 40 for the fixing belt includes a nickel layer 41, a copper layer 42, and a nickel protective layer 43 laminated in that order. Further, an elastic layer 44 and a release layer 45 are laminated in that order on the side of the protective layer 43 on the side of the copper layer 42. In addition, a slidable layer 46 is laminated on the inside of the nickel layer 41, that is, on an inner circumference of the base 40 for the fixing belt.

Figure 5:
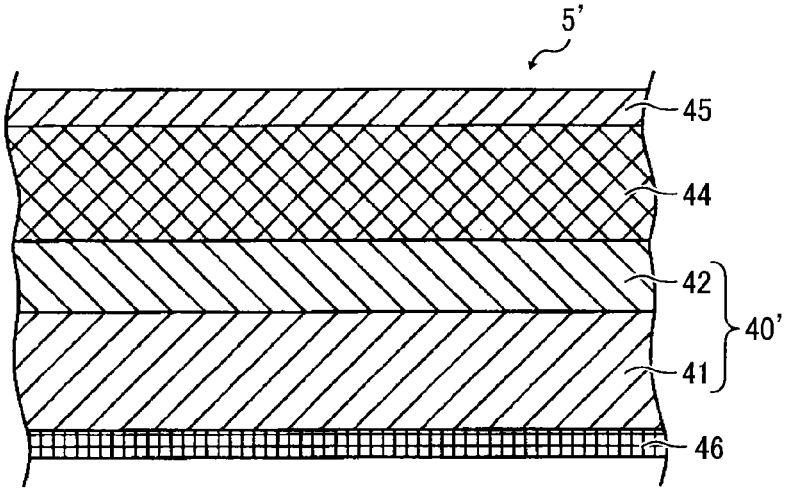
FIG. 5 is a cross-sectional view illustrating a structure of a fixing belt according to another embodiment of the present invention.

FIG. 5 is a cross-sectional view illustrating a structure of a fixing belt 5' according to another embodiment of the present invention. A base 40' for the fixing belt includes a nickel layer 41 and a copper layer 42 laminated on the nickel layer 41. Further, an elastic layer 44 and a release layer 45 are laminated in that order on the side of the copper layer 42. In addition, a slidable layer 46 is laminated on the inside of the nickel layer 41, that is, on an inner circumference of the base 40' for the fixing belt.

The elastic layer 44 allows the fixing belt to follow concavity and convexity caused by the recording sheet or toner when the image is to be fixed, so that the image can be fixed stably on the recording sheet. The elastic layer can be formed of silicon rubber having a thickness of from 100 μm to 200 μm or less. A more preferred thickness is from 100 μm to 150 μm. Use of silicon rubber allows the fixing belt to obtain sufficient heat resistance. If the elastic layer is too thin, the fixing belt cannot follow concavity and convexity formed by the recording sheet or toner in the image fixing operation, resulting in a defective fixation. If the elastic layer is too thick, heat conductivity required for optimal fixation is degraded, resulting in a partially defective fixation.

In addition, the presence of the release layer may prevent smears such as toner particles and other dust from attaching on the surface of the fixing belt, thereby maintaining the function of the fixing belt over a long period. The elastic layer may be formed of PFA laminated in thickness of from 5 μm to 40 μm or less. A more preferred thickness is from 5 μm to 10 μm. If the thickness of the release layer is below 5 μm, the release layer tends to get holes or cracks, thus degrading durability. If the thickness of the elastic layer is too thick, such as more than 40 μm, heat conductivity required for fixation is degraded and the fixing belt cannot follow concavity and convexity caused by the recording sheet or toner in the image fixing operation, resulting in a defective fixation.

As described above, each of the fixing belt 5 and 5' is provided with a slidable layer 46 on the inner circumference thereof. The slidable layer 46 is configured to contact the pressure pad 4 when used in the fixing belt of the fixing device 24 as illustrated in FIG. 2, and allows the fixing belt to rotate following the movement of the transfer medium and the pressure roller.

Such a slidable layer is formed of a layer of polyimide or PFA having an optimal slidability in thickness of from 5 μm to 30 μm or less. A more preferred thickness is from 10 μm to 20 μm. If the thickness of the slidable layer is less than 5 μm, the fixing belt cannot follow concavity and convexity created by the recording sheet or toner in the image fixing operation, resulting in defective fixation. If the elastic layer is too thick, exceeding 30 μm, heat conductivity required for optimal fixation is degraded, resulting in partially defective fixation.

After the formation of the layered structure as above, the fixing belt is cut to obtain a predetermined length. Both lateral ends of the base for the fixing belt according to the present embodiment preferably have a maximum cross-section height Rt of 2 μm or less in the surface roughness evaluation. With such a configuration, portions at which cracking may possibly occur will be reduced, and as a result, an optimal fixing belt with higher durability may be obtained. To obtain the maximum cross-section height Rt, for example, after both ends of the fixing belt are cut, the end portions are polished using polishing paper or elastic grinding stone.

Figure 2:
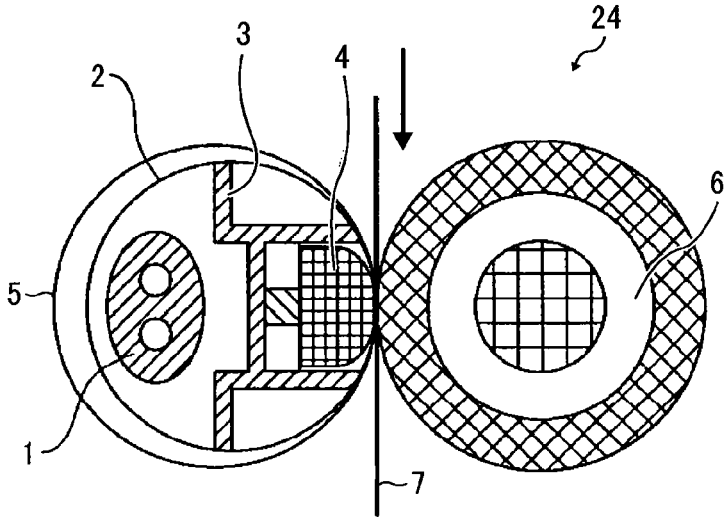
FIG. 2 BACKGROUND ART
FIG. 2 is an exemplary model of a fixing device for use in the image forming apparatus of FIG. 1.
Figure 3:
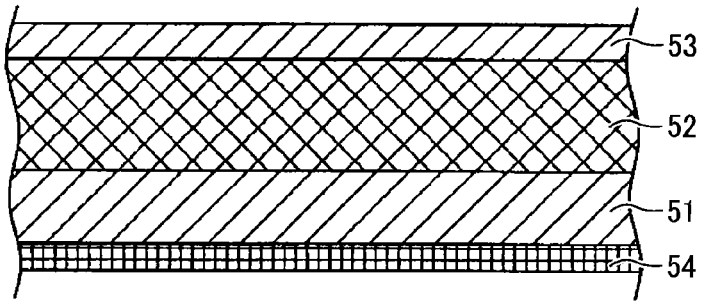
FIG. 3 BACKGROUND ART
FIG. 3 is a cross-sectional view illustrating a structure of a background art fixing belt.

The thus-formed fixing belt is incorporated in the image forming apparatus as illustrated in FIG. 1 having the fixing device as illustrated in FIG. 2. The present fixing belt can be used also preferably in another type of fixing device, without the heat pipe 2, which is different from the fixing device 24 in FIG. 2. In such a fixing device, a heat generating member directly heats the fixing belt and the toner is heated at the nip portion by the heat from the fixing belt.

Preferred embodiments have been described heretofore; however, the base for the fixing belt, the fixing belt, the fixing device, and the image forming apparatus according to the present invention are not limited thereto.

<Base 1 for the Fixing Belt>

Those of ordinary skill in the subject art field can appropriately modify the base for the fixing belt, the fixing belt, the fixing device, and the image forming apparatus within the scope of the present invention.

With reference once again to FIG. 4, the base for the fixing belt including three-layered structure including a nickel layer, a copper layer, and a nickel protective layer will be described with reference to three samples each formed by changing forming conditions of the copper layer.

First, a base for the fixing belt is formed by an electroforming method.

The master block of stainless steel (SUS316) used in electroforming has a cylindrical shape with a diameter of 30 mm. The surface is processed to have a surface roughness Ra (i.e., core wire average roughness) of 0.02 μm or less so that the electroformed film can be easily separated or demolded. The above master block and an anode disposed opposite the master block are set in the electroforming basin.

The electroforming bath has a basic composition of 525 grams/L of nickel sulfamate capable of high-speed electroformation, 33 grams/L of boric acid as pH buffer agent, 3 grams/L of nickel bromide having low tensile stress as nickel halide. Other additives are as follows: 0.02 grams/L of dodecyl sodium sulfate as pit inhibitor. 0.08 grams/L of p-toluene sulfonamide as a primary gloss agent. 0.1 grams/L of 2-butyne-1,4-diol as a secondary gloss agent. 0.2 grams/L of sodium phosphinate (sodium phypophosphite monohydrate) for improving heat resistance of the electroformed film. The pH of the electroforming bath is adjusted to 4 and the temperature at electroformation is adjusted to 55±3 degrees C.

While the master block is being rotated about its cylindrical axis, an electric current of 3 A/dm$^2$ is passed through the bath and a nickel layer having a thickness of 30 μm is formed on the block. Thereafter, the master block on which a nickel layer is formed is removed from the electroforming basin and is washed with water.

Next, copper electroforming is performed. The copper electroforming bath used is an aqueous solution containing 80 grams/L of copper sulfate (II) pentahydrate and 200 grams/L of sulfate. The temperature of the electroforming bath is adjusted to 55±3 degrees C., and currents ranging from 3 to 5 A/dm$^2$ are passed through the bath while rotating the master block, thereby obtaining a copper layer having a thickness of 10 μm. Then, the master block is removed from the electroforming basin, is washed with water, and dried.

A peak strength of the crystal face (200) and a peak strength of the crystal face (111) are measured by X-ray diffraction of these three interim products from the surface of the copper layer, and from the ratio between the two peak strengths the crystal orientation ratio I(200)/I(111) is calculated. Table 1 shows evaluation results and Table 2 shows conditions of X-ray diffraction analysis.

TABLE 1

| Base for fixing belt | Orientation ratio | Number of prints | Occurrence of cracks or fracture |
|---|---|---|---|
| Example 1(1) | 0.066 | 400000 | None |
| Example 1(2) | 0.092 | 400000 | None |
| Example 1(3) | 0.015 | 400000 | None |
| Example 2 | 0.095 | 400000 | None |
| Example 3 | 0.015 | 400000 | None |
| Comparative Example 1 | 0.268 | 100000 | Fractured |
| Comparative Example 2(1) | 0.492 | 90000 | Fractured |
| Comparative Example 2(2) | 0.430 | 80000 | Fractured |
| Comparative Example 3(1) | 0.163 | 150000 | Fractured |
| Comparative Example 3(2) | 0.200 | 110000 | Fractured |

TABLE 2

| | |
|---|---|
| Equipment | Philips X'Pert PRO ® |
| Tube | Cu |
| Sampling width | 0.02° |
| Tube voltage | 40 kV |
| Tube current | 40 mA |
| Scan axis | 2θ/θ |
| Measurement angle range | 40° to 70° |
| Photoreceptor | Monochrometer |
| Scan speed | 0.04°/sec |
| Divergence slit | 1° |
| Scatter slit | 1° |

Then, similarly to the above nickel layer electroformation, the nickel protective layer having a layer thickness of 1 μm is formed. After the formation of the protective layer, the master block on which the base for the fixing belt is formed is soaked in cold water, a gap is formed between the master block and the base for the fixing belt due to the heat expansion, and then, the base for the fixing belt is separated from the master block, thereby obtaining three types of bases 1(1) to 1(3) for the fixing belt according to the present invention.

<Base 2 for the Fixing Belt>

Similarly to the base 1(2), without providing a protective layer, a base for the fixing belt having two layers of the nickel layer and the copper layer is formed, which corresponds to the base 40' of FIG. 5. In this case, the crystal orientation ratio I(200)/I(111) calculated from a ratio between the peak strength of the crystal face (200) and the peak strength of the crystal face (111) of the copper layer is represented in Table 1.

<Base 3 for the Fixing Belt>

Similarly to the base 1(3), with the thicknesses of both the nickel layer and the copper layer set at 20 μm, that is, a base for the fixing belt having three layers of the nickel layer, the copper layer, and the protective layer is formed. In this case, the crystal orientation ratio I(200)/I(111) of the copper layer is listed in Table 1.

Comparative Example 1

Similarly to the base 1(1) for the fixing belt, a base for the fixing belt having three layers is formed by adding gelatin as a gloss agent into the copper electroforming bath so as to be a density of 10 ppm. In this case, the crystal orientation ratio I(200)/I(111) of the copper layer is listed in Table 1.

<Comparative Base 2>

Similarly to the bases 1(1) and 1(2) for the fixing belt, however, by adding hydrochloric acid as a gloss agent into the copper electroforming bath to be a density of 60 ppm, the base having three layers for the fixing belt is formed, respectively. They are the bases 2(1) and 2(2) for the fixing belt as a comparative example 2. In this case, the crystal orientation ratio I(200)/I(111) of the copper layer is listed in Table 1.

<Comparative Base 3>

Similarly to the bases 1(2) and 1(3) for the fixing belt, however, by adding gelatin to be a density of 10 ppm and hydrochloric acid to be a density of 60 ppm into the copper electroforming bath, the base having three layers for the fixing belt is formed, respectively. They correspond to the base 3(1) and 3(2) according to the comparative example 2. In this case, the crystal orientation ratio I(200)/I(111) of the copper layer is listed in Table 1.

<Formation of Fixing Belt>

A fixing belt is formed using each of the ten bases described above.

An elastic layer formed of silicon rubber is formed on an outer circumference of the base for the fixing belt with a thickness of 120 μm by coating a precursor agent via a spray coating method, and applying heat treatment at 150 degrees C. for 2 hours. Next, a PFA layer with a thickness of 10 μm is formed as a release layer on the elastic layer by coating the precursor agent via the spray coating method, and then, applying heat treatment at 340 degrees C. for 2 hours.

Further, a polyimide layer as a lubricant layer with a thickness of 15 μm is formed on an inner circumferential surface of the base for the fixing belt by coating and then applying heat treatment at 200 degrees C. for 30 minutes.

Then, both lateral ends of an interim product of the base for the fixing belt is cut out, polishing treatment is applied to the cut surfaces with an instrument formed of the polishing paper wound around an elastic member, so that the maximum cross-section height Rt of 2 μm or less in the surface roughness evaluation and a length of 370 mm are obtained.

<Evaluation of Fixing Belt>

Ten types of fixing belts are evaluated.

Each fixing belt is mounted on the fixing device of the image forming apparatus as a typical model of FIG. 1, and fixing performance is evaluated through printing A4-sized 400,000 sheets under the same conditions. Each sheet is supplied to the apparatus with its longitudinal side along the sheet conveyance direction. In this case, presence or absence of cracks or fracture in the fixing belt has been investigated. Then the processed number of sheets is counted in the unit of 10,000 sheets until the crack or fracture has broken out if such an event occurs during the fixing operation. The evaluation results are shown in Table 1.

Table 1 shows that the fixing belt that employs the base for the fixing belt according to the present invention having the orientation ratio I(200)/I(111) of 0.1 or less obtained by X-ray diffraction analysis has superior durability. The fixing belt according to the present invention does not show uneven fixing error, and the obtained image is generally uniform even in the solid part of the image. Thus, it is confirmed that the copper layer exhibits effects of preventing uneven temperature from occurring.

Using the base for the fixing belt produced in the similar manner as in the base 1(2) for the fixing belt, the elastic layer, the release layer, and the lubricant layer are formed similarly, and the fixing belt is formed without polishing the two ends after the lateral ends are cut. The maximum cross-section height Rt of the two ends of the base for the fixing belt in the surface roughness evaluation is 2.2 μm, and when the same fixing belt is evaluated as in the above method, fracture occurs at a time of fixation operation of 350,000 sheets.

Additional modifications and variations of the present invention are possible in light of the above teachings. It is therefore to be understood that, within the scope of the appended claims, the invention may be practiced other than as specifically described herein.

What is claimed is:

1. A base for a fixing belt, comprising:

a nickel layer; and a copper layer laminated on the nickel layer, wherein an orientation ratio I(200)/I(111) calculated based on a ratio between a peak strength of (200) crystal face and a peak strength of (111) crystal face by X-ray diffraction analysis of the copper layer is 0.1 or less.

2. The base for the fixing belt as claimed in claim 1, further comprising a protective layer, disposed on an exposed surface of the copper layer opposite a surface on which the nickel layer is laminated.

3. The base for the fixing belt as claimed in claim 2, wherein the protective layer is formed of nickel.

4. The base for the fixing belt as claimed in claim 1, wherein the base has a thickness of from 20 μm to 50 μm and the nickel layer has a thickness greater than that of the copper layer.

5. A fixing belt comprising:

a base as claimed in claim 1;

an elastic layer; and a release layer, wherein the fixing belt is an endless belt, the copper layer is disposed on an outer circumference of the base of the fixing belt, and the elastic layer and the release layer are laminated in that order on the outer circumference of the base of the fixing belt.

6. The fixing belt as claimed in claim 5, wherein a maximum cross-section height of both ends of the base in surface roughness evaluation is 2 μm or less.

7. A fixing device comprising a fixing belt as claimed in claim 5.

8. An image forming apparatus comprising a fixing belt as claimed in claim 5.

9. The fixing belt of claim 5, wherein the elastic layer has a thickness of 100 μm to 150 μm.

10. The fixing belt of claim 5, wherein the release layer has a thickness of 5 μm to 10 μm.

11. The fixing belt of claim 5, wherein the fixing belt further includes a slidable layer.

12. The fixing belt of claim 11, wherein the slidabie layer has a thickness of 5 μm to 30 μm.

13. An image forming apparatus, comprising:

a fixing belt including the base of claim 1;

a pressure roller disposed opposite the fixing belt; and a pressure pad disposed inside the fixing belt and pressing against the pressure roller via the fixing belt, wherein the pressure pad forms a fixing nip to fix an unfixed image onto a transfer medium, together with the fixing belt and the pressure roller.

14. The image forming apparatus of claim 13, further comprising:

a heat generator disposed inside the fixing belt, wherein the fixing belt is heated by the heat generator.

15. The image forming apparatus of claim 14, wherein the heat generator is disposed opposite the pressure roller via a heat pipe.

16. The image forming apparatus of claim 14, wherein the heat generator directly heats the fixing belt.

* * * * *